US007496973B2

(12) United States Patent
Jewell et al.

(10) Patent No.: US 7,496,973 B2
(45) Date of Patent: Mar. 3, 2009

(54) ATHLETIC PANTS WITH INTEGRAL KNEE SUPPORT

(75) Inventors: Gayle L. D. Jewell, Richmond Hill (CA); Russell G. Kitteringham, 2A Long Hill Dr., Richmond Hill, Ontario (CA) L4E 3M5; Robert G. Dickie, King City (CA); Steven Copeland, Barrie (CA)

(73) Assignees: Gayle L. D. Jewel, Richmond Hill (CA); Russell G. Kitteringham, Richmond Hill (CA)

( * ) Notice: Subject to any disclaimer, the term of this patent is extended or adjusted under 35 U.S.C. 154(b) by 0 days.

(21) Appl. No.: 11/153,527

(22) Filed: Jun. 15, 2005

(65) Prior Publication Data

US 2006/0282938 A1 Dec. 21, 2006

(51) Int. Cl.
*A41D 13/00* (2006.01)

(52) U.S. Cl. ..... 2/227

(58) Field of Classification Search ..... 2/227, 2/228, 16, 79, 69, 456, 911, 22, 24; 128/878, 128/881, 882; 602/16, 26, 62
See application file for complete search history.

(56) References Cited

U.S. PATENT DOCUMENTS 3,786,804 A * 1/1974 Lewis ..... 602/16
3,900,898 A * 8/1975 Ackerman ..... 2/22
4,064,874 A * 12/1977 Valin ..... 602/26
4,156,294 A 5/1979 Horn
4,811,427 A 3/1989 Regan
4,850,056 A 7/1989 Gardner et al.
5,139,477 A * 8/1992 Peters ..... 602/26
6,023,789 A 2/2000 Wilson et al.
6,231,488 B1 * 5/2001 Dicker et al. ..... 482/124
6,701,533 B2 * 3/2004 Webb ..... 2/303
6,782,559 B2 8/2004 Regan

* cited by examiner

*Primary Examiner*—Tejash Patel
(74) *Attorney, Agent, or Firm*—Sand & Sebolt

(57) ABSTRACT

An athletic pant that includes an area of compressive fabric disposed in a position on either pant leg that will surround the athlete's knee when the pants are worn. The area of compressive fabric in each pant leg also includes a pair of pockets positioned to lie on either side of the athlete's knee. The pockets can be opened to receive a support and closed to secure the support therein, whereby the support restricts lateral movement of the athlete's knee. If the athletic pants are to be used for ice hockey, the pants may also include connectors disposed on the outer surface of the pant legs for the connection of hockey socks.

17 Claims, 5 Drawing Sheets

ATHLETIC PANTS WITH INTEGRAL KNEE SUPPORT

BACKGROUND OF THE INVENTION

1. Technical Field

This invention generally relates to athletic apparel. More particularly, the invention relates to pants for use by ice hockey players. Specifically, the invention relates to a pair of pants that are manufactured from a stretch-type fabric and include reinforcing supports in the areas that will lie on either side of a player's knee.

2. Background Information

It is fairly common for athletes to sustain injuries to their knees during practice sessions or games. In many instances, the athlete has to use a support of some type to protect their knees in order to prevent further injury or to hold their knee in a particular position to reduce pain. Many supports and brace type devices have been disclosed in the prior art for protecting and supporting knees. These devices include tensor bandages, elastic knee braces, and knee supports that include plastic strips or rigid, hinged aluminum strips to keep the knee in a certain position. Some of these support devices are simply pulled over the athlete's foot and raised up to their knee and the elasticity of the device holds it in place. Most of these appliances, however, are positioned proximate the athlete's knee with a series of straps. The appliances need to be positioned accurately to ensure proper limitation of the movement of the knee.

The prior art appliances work fairly well until they come into contact with clothing such as football or baseball pants that end at or below the knee. As these pants move up and down in response to movement by the athlete, they tend to rub against the knee supporting appliance and push or pull the support out of the optimum position. This may not only prevent the appliance from protecting the athlete's knee but can also result in the athlete's play being impeded because the appliance gets in the way.

This problem has been partially addressed in the prior art, such as in the device proposed in U.S. Pat. No. 4,850,056, issued to Gardner et al. Gardner et al discloses a pair of athletic pants that are designed to be worn over a knee supporting device such as a device that is secured to the athlete's leg by straps wrapped around the thigh and calf. Gardner's athletic pants include a flap sewn onto the inner surface of the pant leg at a position that would fall slightly above the athlete's knee. The thigh strap of the supporting device can be releasably connected to this flap to reduce the tendency of the supporting device to slide down the athlete's leg in response to movements of the pants. Gardner et al's pants may help in keeping the knee supporting device in a slightly better position that if there was no connection between the pants and supporting device, but the athlete has to secure the knee supporting device to their knee, pull the pant leg over the device and then secure the device to the flap. During the step of pulling the pant leg over the device, the device can be shifted out of optimum position. Furthermore, the positioning of the flap and the strap of the device can be slightly off, resulting in the device being shifted by the flap when the athlete next moves.

There is therefore a need in the art for an improved device for supporting the knee of an athlete that allows for correct positioning of the support around the knee and that is easier to put on and maintain in the correct position.

SUMMARY OF THE INVENTION

The device of the present invention is an athletic pant that includes an area of compressive fabric disposed in a position on either pant leg that will surround the athlete's knee when the pants are worn. The area of compressive fabric in each pant leg also includes a pair of pockets positioned to lie on either side of the athlete's knee. The pockets can be opened to receive a support and closed to secure the support therein, whereby the support restricts lateral movement of the athlete's knee. If the athletic pants are to be used for ice hockey, the pants may also include connectors disposed on the outer surface of the pant legs for the connection of hockey socks.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
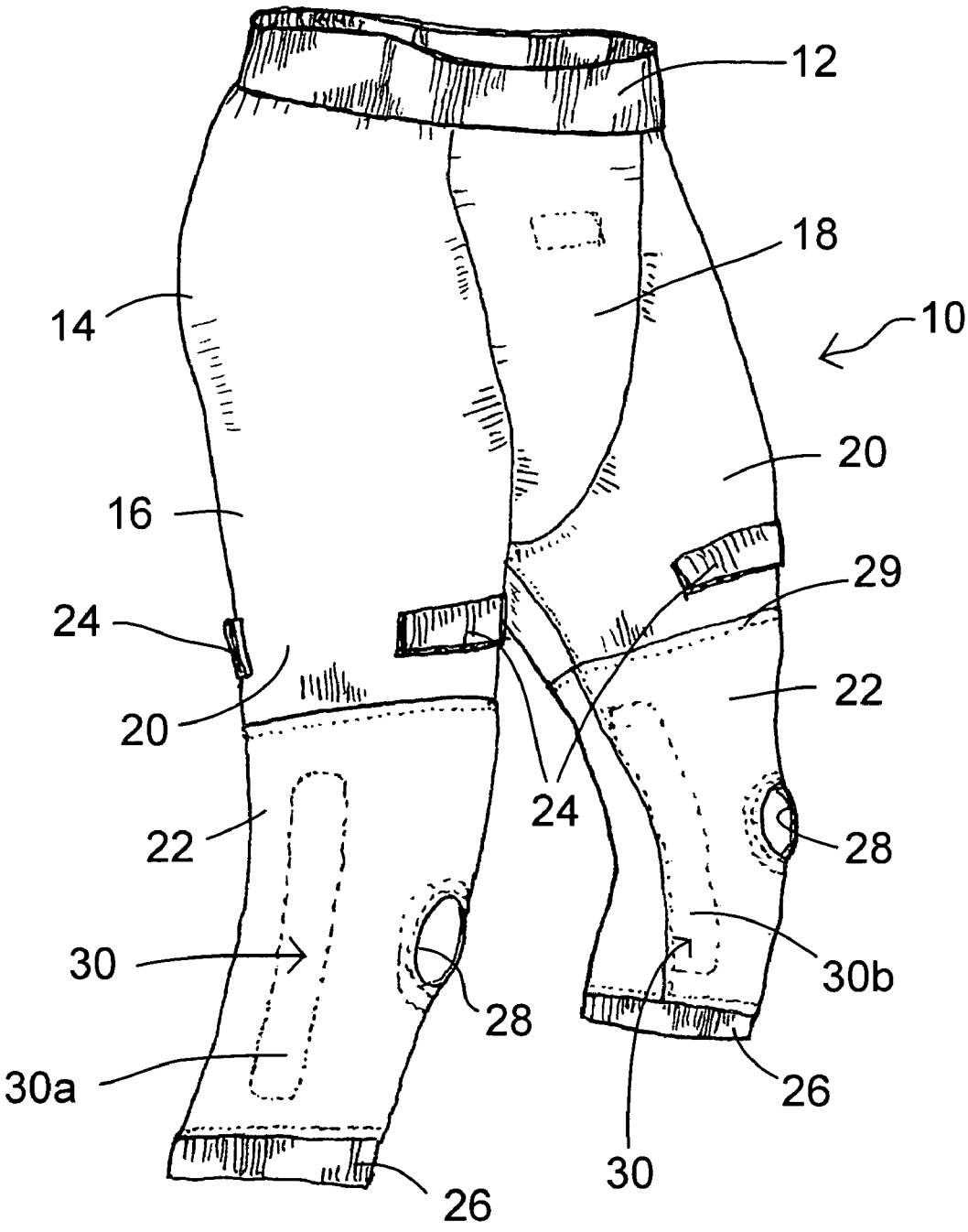
FIG. 1 is a perspective view of a first embodiment of athletic pants in accordance with the present invention.
Figure 2:
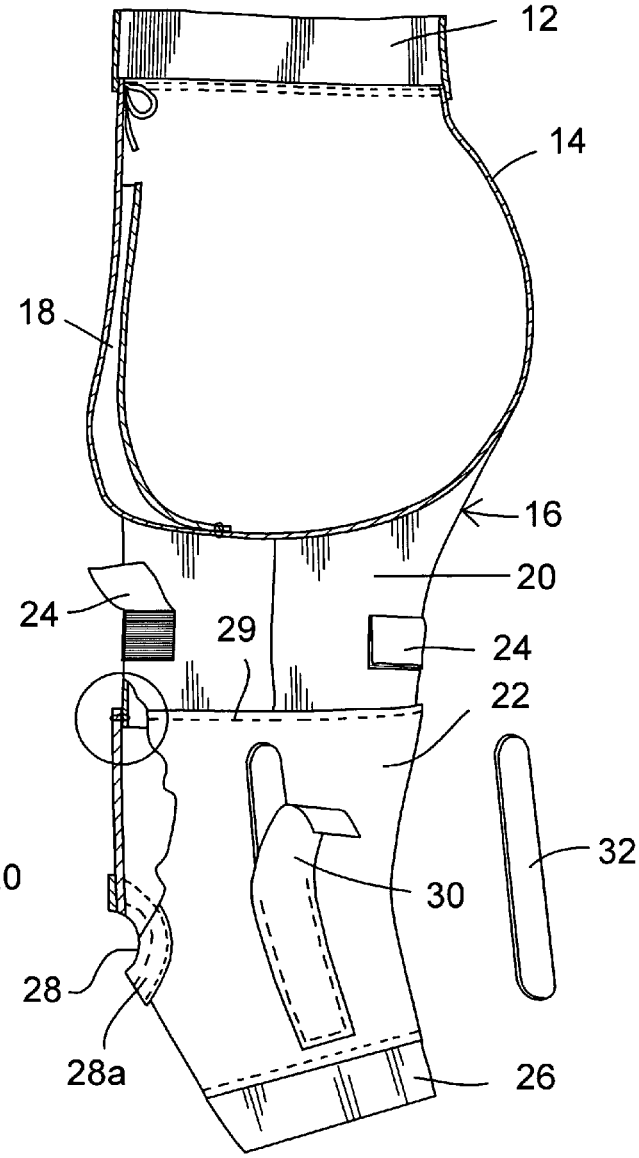
FIG. 2 is a partial cross-sectional side view of the athletic pants of FIG. 1 and showing the support removed from the pocket.

Referring to FIGS. 1 & 2, there is shown a pair of athletic pants in accordance with the present invention and generally indicated at 10. Pants 10 include an elastic waistband 12, a body 14 and two pant legs 16 extending outwardly from body 14. Body 14 encompasses the abdomen and buttocks of the player and may include pockets 18 for holding protective equipment such as cups or pads (not shown).

Each leg 16 of pants 10 includes a first region 20 designed to encompass the upper portion of an athlete's thigh and a second region 22 designed to encompass the lower portion of the athlete's thigh, their knee and the upper portion of their calf. First region 20 is integrally formed with body 14 and preferably is manufactured from the same fabric. The fabric selected for first region 20 depends on the type of sport that the pants 10 are used for. The athletic pants 10 shown in FIGS. 1 & 2 are used in playing ice hockey. First region 20 is consequently manufactured from a fabric such as spandex and nylon. Ice hockey players wear long socks (not shown) that are held up by a suitable means such as a strap secured around the player's thigh or by hook and pile fasteners positioned on another garment. Athletic pants 10 in accordance with the present invention include a plurality of strips 24 of hook and pile fasteners positioned at intervals on first region 20 of pant legs 16. As will be later described, the long socks are pulled up over pants 10 and the top of the socks are secured to strips 24.

In accordance with one of the specific features of the present invention, second region 22 extends outwardly away from first region 20. Second region 22 is manufactured from a stretchy, elastic material that preferably places those parts of the leg it covers under compression. Second region 22 is therefore adapted to fit tightly around the lower thigh, knee and upper calf of the player. In the case of athletic pants for ice hockey players, second region 22 preferably is manufactured from a material such as neoprene rubber. An elastic cuff 26 is provided at the end of second region 22 to assist in keeping the second region from riding up the athlete's leg. Second region 22 also includes an aperture 28 which is positioned to align with the athlete's kneecap (not shown) and which allows second region 22 to be bent in a manner that substantially prevents the cuff 26 from riding up on the athlete's leg. A reinforced area 28*a* is provided immediately surrounding aperture 28. Reinforced area 28*a* serves to apply pressure to prevent second region 22 from tearing or shifting during movement of the athlete's leg.

In accordance with another specific feature of the present invention, second region 22 is provided with a pair of pockets 30*a*, 30*b* which each receive a support 32 therein. The pockets 30*a*, 30*b* are positioned one on either side of aperture 28. Each pants leg 16 has a longitudinal axis that runs from waistband 12 through to the bottom 26 of second region 22. Pockets 30*a*, 30*b* are oriented substantially parallel to the longitudinal axis of their respective pant leg 16. Pockets 30*a*, 30*b* may be formed by securing a segment of material over second region 22 by way of stitches and/or a hook and pile fastener material such as that sold under the Velcro® trademark. (Velcro® is a registered trademark of Velcro Industries B.V. of the Netherlands.) Supports 32 are planar or hinged members manufactured from plastic, aluminum or any other suitable material that is rigid and will therefore provide lateral support for the athlete's knee. Pockets 30*a*, 30*b* are partially stitched to second region 22 and include a section that is closed by way of hook and pile fasteners. This allows supports 32 to be inserted into pockets 30*a*, 30*b* and to be retained therein. Supports 32 may be removed from pockets 30*a*, 30*b* when athletic pants 10 are washed or if a support 32 breaks and needs to be replaced.

Figure 3A:
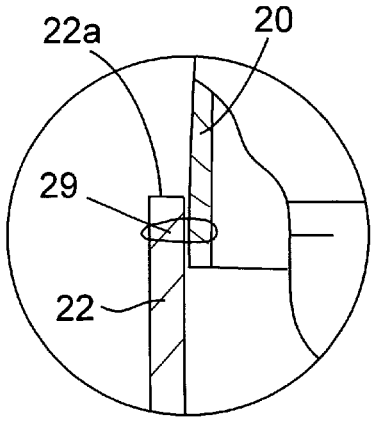
FIG. 3*a* is an enlarged cross-sectional side view of the circled area of FIG. 2 showing a permanent connection of the stretchy fabric to the athletic pants.
Figure 3B:
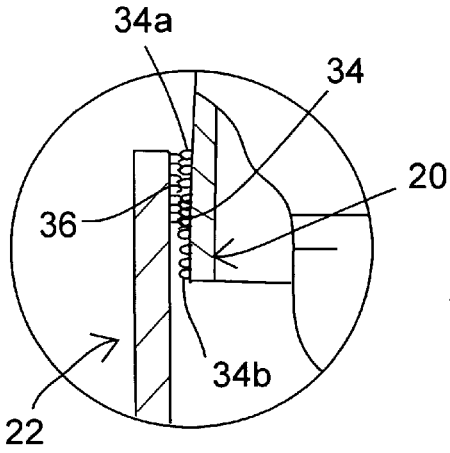
FIG. 3*b* is an enlarged cross-sectional side view of the circled area of FIG. 2 showing a first mechanism for adjusting the position of the stretchy fabric on the athletic pants and to thereby adjust the relative position of the stretchy fabric on an athlete's leg.

As can be seen in FIGS. 3*a* and 3*b*, first and second regions 20, 22 may be connected together in different ways. FIG. 3*a* illustrates the instance where first and second regions 20, 22 are permanently sewn together and therefore the aperture 28 for the patella (knee-cap) is preset a certain distance from waistband 12. First and second regions 20, 22 are sewn together with first region 20 positioned inwardly of second region 22 so that second region 22 overlaps first region 20. This arrangement is preferred as the athlete's foot will not become snagged on the end 22*a* of second region 22 when the pants 10 are pulled on. It will, however, be understood that second region 22 may alternatively be placed on the inside of first region 20, without departing from the spirit of the present invention. Furthermore, it will be understood that any other type of seam may be utilized to connect the first and second regions together without departing from the present invention.

FIG. 3*b* shows an arrangement for connecting the first and second regions 20, 22 together in a manner that allows the distance between waistband 12 and aperture 28 to be adjusted for an improved fit. In this second instance, one of first and second regions 20, 22 is provided with a circumferential band 34 of hook-type fasteners and the other of the first and second regions 20, 22 is provided with a circumferential band 36 of pile-type fasteners. The athlete can therefore adjust the position of the second region 22 relative to the first region 20 by increasing or decreasing the distance between waistband 12 and first and second regions 20, 22. So, if the athlete has a shorter thigh, fasteners 36 on second region 22 are positioned proximate the upper edge 34*a* of the band of fasteners 34 on first region 20 (FIG. 3*b*). If the athlete has a longer thigh, the band of fasteners 36 on second region 22 is positioned proximate the bottom edge 34*b* of the band of fasteners 34 (not shown). This adjustability allows the athlete to place the supports 32 at the correct position along either side of their knee.

Athletic pants 10 are used in the following manner. The athlete (not shown) inserts his feet through an aperture (not shown) that is surrounded by cuff 26. He draws the pants upwardly until waistband 12 is comfortably seated around his waist. He manipulates second region 22 so that his knee-cap protrudes through aperture 28. At this point, the upper portion of each of the athlete's thighs are covered by first region 20 and the lower portion of his thighs are covered by that part of second region 22 that lies between aperture 28 and the seam 29 between first and second regions 20, 22. Furthermore, the upper portion of each calf is covered by that part of second region 22 that lies between aperture 28 and cuff 26. Pockets 30*a* and 30*b* in each pant leg 16 are positioned on either sides of the athlete's knee and supports 32 in each of the pockets 30*a*, 30*b* are disposed so as to substantially prevent lateral movement of the knee. The athlete who, for the purposes of this description, is an ice hockey player, pulls on each of his hockey socks (not shown) and draws the upper end of each sock upwardly toward his waist until the upper end can engage with the Velcro® straps 24 and be locked in place. He can then pull on his shorts over pants 10 and engaged hockey socks, will put on his ice skates (not shown) and be ready to play. If it is found that support 32 is broken or needs to be removed for some other reason, the athlete can simply disengage the upper end of his hockey socks from straps 24, pull the sock down and open the Velcro® fasteners on pocket 30*a*, for example, and gain access to support 32 inside that pocket. When he is finished adjusting or replacing support 32, pocket 30*a* may be closed again by closing the Velcro® fasteners, thereby securing support 32 in pocket 30*a*. The hockey socks can be pulled up again and be reengaged with straps 24. It will be understood that the supports 32 can be placed in pockets 30*a*, 30*b* prior to the athlete putting the pants 10 on or, alternatively, supports 32 can be placed in pockets 30*a* and 30*b* after the athlete has already pulled pants 10 on. It will also be understood that supports 32 can be removed from pockets 30*a*, 30*b* whether pants 10 are on the athlete or off the athlete.

Referring to FIG. 3*b*, athletic pants 10 that include this form of attachment between first region 20 and second region 22 can be adjusted to ensure that aperture 28 is correctly aligned with the athlete's knee-cap. This adjustment can be made before pants 10 are put on or after pants 10 are put on. In order to make the adjustment, the athlete pulls the hook and pile fasteners out of engagement with each other and then adjusts the relative position of the bands 34 and 36 relative to each other. If the athlete wants to shorten the distance between waistband 12 and aperture 28, then band 36 is positioned proximate the upper end 34*a* of band 34. If the athlete wants to lengthen the distance between waistband 12 and aperture 28, then band 36 is positioned proximate the bottom end 34*b* of band 34. Once the bands 34, 36 are placed in the desired position relative to each other, the hook and pile fasteners in bands 34, 36 are pushed back into contact with each other, thereby securing first and second regions 20, 22 together.

Figure 4:
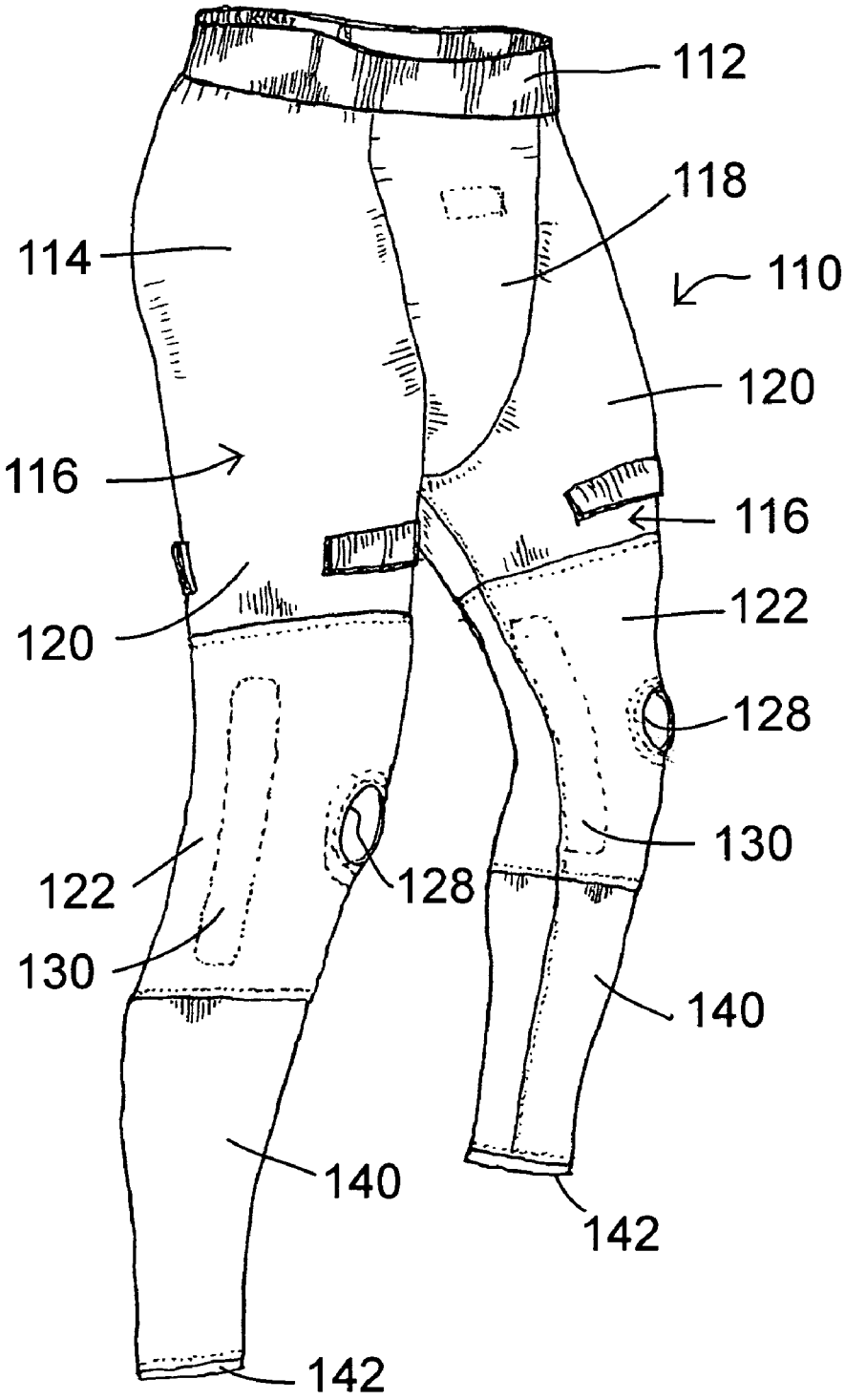
FIG. 4 is a perspective view of a second embodiment of athletic pants in accordance with the present invention.

Referring to FIG. 4, there is shown a second embodiment of athletic pants in accordance with the present invention and generally indicated at 110. As with the first embodiment, athletic pants 110 include an elastic waistband 112, a body 114 and pant legs 116 extending outwardly from body 114. A pocket 118 is formed on body 114 for receiving protective equipment such as a cup (not shown). Pant legs 116 comprise a first region 120, a second region 122 and a third region 140. First region 120 preferably is sewn to second region 122 and second region 122 preferably is sewn to third region 140. Third region 140 is adapted to extend to the ankles of the athlete and consequently tapers from its attachment to second region 122 down to the end 142. End 142 may comprise an elastic cuff. First and third regions 120, 140 preferably are made from the same material, with second region 122, being made from a different material, namely a stretchy, elastic fabric such as neoprene rubber that compresses the parts of the body that it contacts. All of the components of the second region 122 are substantially identical to the components of that region in athletic pants 10. It will be understood that while the above description indicates that the first, second and third regions 120, 122 and 140 are sewn together, the first and second regions 120, 122 may be joined together by circumferential bands of mating hook and pile fasteners. This type of attachment would ensure that the position of the second region 122 is adjustable.

Athletic pants 110 are used in the same manner as athletic pants 10, except the athlete inserts his foot through an aperture (not shown) in proximate the bottom 142 of third region 140. The bottom 142 of third region 140 is adapted to encircle the athlete's ankle. Once the waistband 112 surrounds the athlete's waist, he then adjusts the position of second region 122 until his knee-cap is positioned behind aperture 128 and pockets lie on either side of his knee. The athlete can then pull on his hockey socks and connect them to pants 110 in the manner described with respect to the previous embodiment of the invention.

Figure 5A:
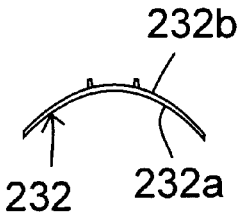
FIG. 5*a* is a top view of the arcuately-shaped support that is receivable within the pocket of the pants of FIG. 5.
Figure 5:
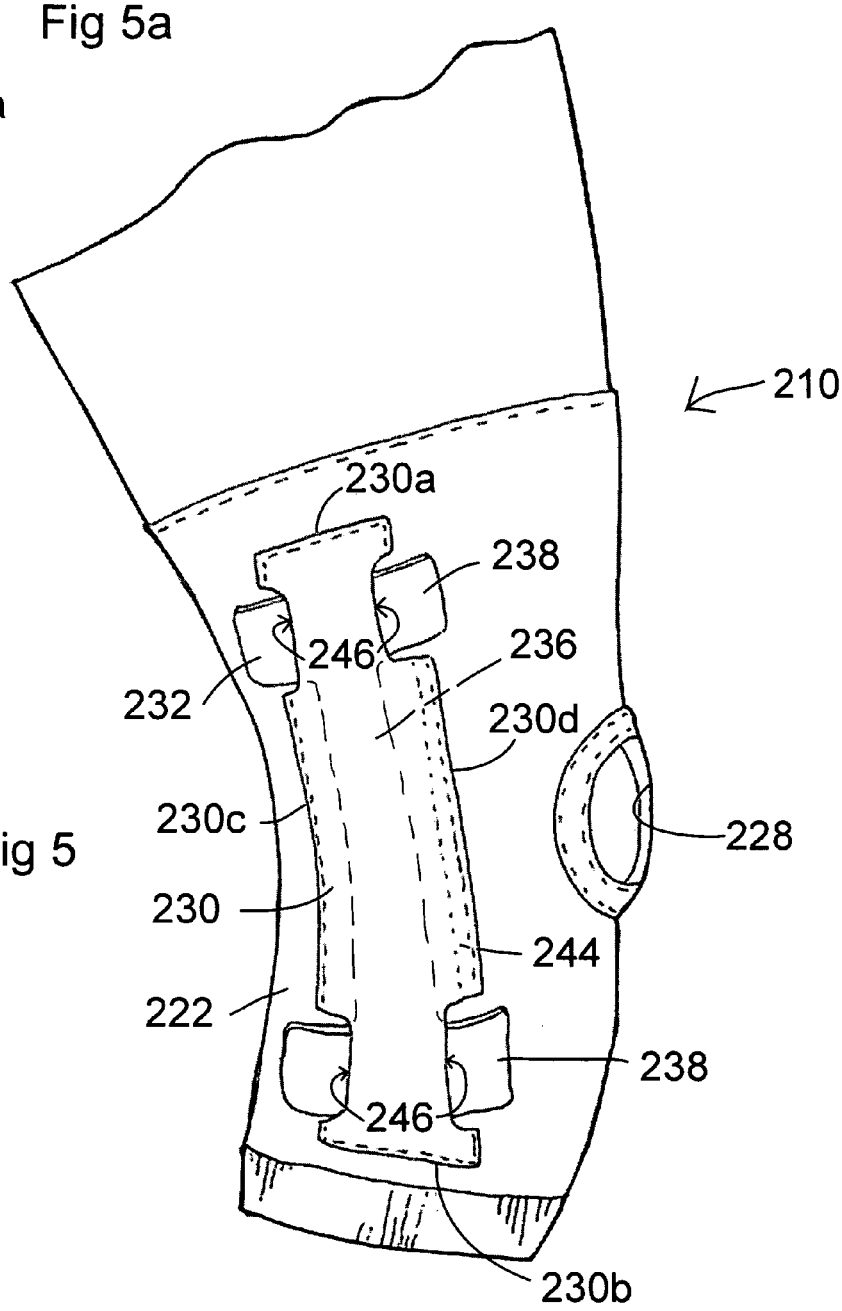
FIG. 5 is a partial perspective view of a third embodiment of athletic pants in accordance with the present invention, where the pants include a pocket for receiving a support that is arcuate in shape.

A third embodiment of athletic pants in accordance with the present invention is shown in FIGS. 5 & 5*a* and is generally indicated at 210. The structure of pants 210 is substantially identical to the structure of pants 10 except for the pocket 230 provided for holding a support 232. Support 232 is substantially I-shaped comprising a central portion 236 with flexible upper and lower arms 238 lying substantially at right angles thereto. Pocket 230 is generally I-shaped and is sewn onto second region 222 along a top edge 230*a*, a bottom edge 230*b* and a first side 230*c*. The opposite side 230*d* is secured to second region 222 by mating hook and pile fasteners 244. The central portion of pocket 230 includes a wider region flanked by two narrower regions. The narrower regions of pocket 230 include openings 246 through which arms 238 of support 232 extend. Support 232 is arcuate in shape when viewed from the top or bottom (FIG. 5*a*) and this shape helps support 232 to be positioned on the athlete's leg and remain in place in pocket 230. The aperture 238 helps hold second region 222 centered on the athlete's knee-cap.

Athletic pants 210 are put on and pulled off in the same manner as previously described and support 232 can be inserted into pocket 230 whether pants 210 are on or off the athlete. In order to insert support 232 into pocket 230, the free edge 230*d* of pocket is lifted up so that hook and pile fasteners 244 disengage from each other. Support 232 is then oriented so that the interior curved surface 232*a* (FIG. 5*a*) of support 232 will abut the outer surface of second region 222 and the exterior curved surface 232*b* of support 232 will abut the interior surface of pocket 230. Support 232 is slid into pocket 230 so that arms 238 are received through apertures 246 proximate the secured side 230*c* of pocket 230. Hook and pile fasteners 244 are pressed into contact with each other, thereby locking support 232 inside pocket 230. The athlete can make slight adjustments to the position of support 232 by pushing on the arms 238 of support 232 until the interior curved surface 232*a* hugs the athlete's leg through second region 222. The compression of second region 222 keeps support 232 properly positioned against the side of the athlete's leg.

Figure 6:
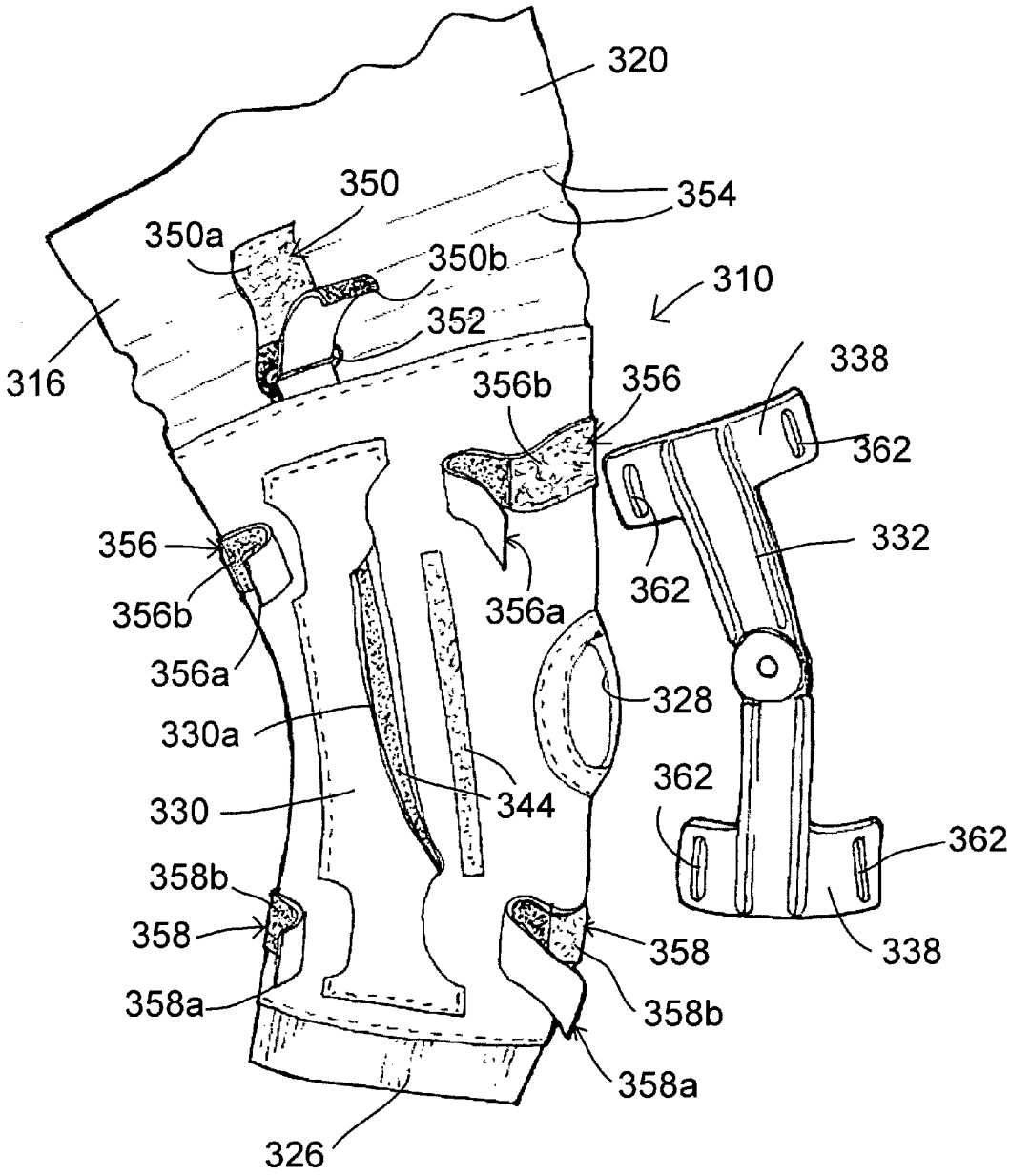
FIG. 6 is a partial perspective view of a third embodiment of athletic pants that includes a recloseable pocket for receiving a support, straps for aiding in holding the support in the correct position and a second mechanism for adjusting the position of the stretchy fabric on the athletic pants.

A fourth embodiment of athletic pants in accordance with the present invention is shown in FIG. 6 and is generally indicated at 310. Athletic pants 310 include a plurality of straps 350 and cooperating buckles 352 positioned at intervals on first region 320 of pants 310. A first part 350*a* of each strap 350 is secured to first region 320 and a second part of each strap terminates in a free end 350*b* that may be threaded through buckle 352. Straps 350 have hook-type fasteners at one of the secured end 350*a* and free end 350*b* and pile-type fasteners at the other of the secured end 350*a* and free end 350*b*. Upper straps 356 and lower straps 358 are provided on second region 322. Straps 356, 358 lies substantially at right angles to the longitudinal axis of pant leg 316, the longitudinal axis being defined as the direction from the waistband (not shown) to the cuff 326. Support 332 is a hinged member that includes upper and lower arms 358 which are provided with apertures 362 therein. Each of straps 356, 358 includes a section of hook fasteners and a section of pile fasteners. Straps 356, 358 are attached to the respective pant leg 316 in manner that allows the free ends 356*a*, 358*a* of straps 356, 358 to be threaded through apertures 362 and folded back onto the fixed portion 356*b*, 358*b* of the straps. This holds supports 332 in place. Pocket 330 has substantially the same structure as pocket 230.

Athletic pants 310 are used in the following manner. As with the other embodiments of this invention, pants 310 are pulled on in a conventional manner and support 332 can be inserted into pocket 330 prior to pants 310 being pulled on or after pants 310 are pulled on. Furthermore, pants 310 can be adjusted when the pants are on or when they are off. The pants are adjusted by threading free end 350*b* of strap 350 through buckle 352. Free end 350*b* is pulled upwardly toward the waistband (not shown) and this causes the creation of gathers or folds 354 in first region 320 and causes the distance between the waistband (not shown) and aperture 338 to be reduced. (It will be understood that if the athlete desires to increase the distance between waistband and aperture 338, he pulls downwardly on second region 322 to remove some of the folds 354. When the desired distance between aperture 338 and waistband (not shown) is achieved, free end 350*b* of strap 350 is pushed into contact with fixed end 350*a* of strap 350 to allow the hook and pile fasteners thereon to engage. The athlete can consequently adjust the position of second region 322 to where the aperture 328 is correctly positioned around his knee-cap.

Support 332 is inserted into pocket 330 in the same manner as support 232 is inserted into pocket 230. Free ends 356*a*, 358*a* of each strap 356, 358 are each inserted through its respective aperture 362, the ends are pulled outwardly through apertures 362 until support 332 lies in contact with the athlete's leg, separated only by the material of second region 322. Free ends 356*a*, 358*a* are then pushed into contact with the fixed parts 356*b*, 358*b* of the straps to allow the hook and pile fasteners to engage. The free side 330*a* is then pushed into contact with second region 322 so that fasteners 344 engage with each other and thereby secure support 332 within pocket 330. Straps 350, 356 and 358 can be adjusted to ensure that supports 332 are held in the correct position on either side of the athlete's knee.

It will be understood that while the pockets on the second region have been shown as being partially sewn to second region and partially securable thereagainst by way of hook and pile fasteners, during manufacture of any of the embodiments of the athletic pants the supports can be inserted into the pockets and the pockets can be completely sewn to the second region. This would result in the support being permanently held within the pocket and not being removable therefrom.

It will also be understood that the shape of the pocket and the shape of the support are complementary, but the specific shapes of the two components can vary in accordance with the type of isolation of the knee that the pants are designed to address.

It will be further understood that the pocket preferably is made from the same material as the second region, although this is not necessary.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. Athletic pants for providing support to an athlete's knees, the pants comprising:

a waistband adapted to encircle the athlete's waist;

a body extending from the waistband and adapted to receive the athlete's abdomen and buttocks therein;

a pair of pant legs extending outwardly from the body; each pant leg terminating in a first annular region configured to be disposed substantially mid-thigh on the athlete's leg; and wherein said body and pant legs are manufactured from an elastic material;

a tubular knee support region extending outwardly from the first annular region of each of the pant legs; each knee support region terminating in a second annular region configured to be disposed substantially mid-calf on the athlete's leg; said knee support regions being manufactured entirely from a compressive, elastic material;

at least one pocket formed in each knee support region in an area adapted to be laterally adjacent the athlete's knee; and a supporting member retained within each pocket; wherein the entire supporting member is enveloped within said pocket so that no part of the supporting member is visible; and wherein the pants are free of straps that would compress the knee support region and the supporting member therein against the knee of the athlete.

2. The athletic patents as defined in claim 1, wherein said supporting member is non-removably retained within the pocket.

3. The athletic pants as defined in claim 2, wherein each of the knee support regions further defines an aperture therein, wherein the aperture is positioned to align with the athlete's knee when an athlete is wearing the athletic pants.

4. The athletic pants as defined in claim 3, further comprising an additional layer of material disposed in the region immediately surrounding the aperture; whereby said aperture is reinforced by said additional layer.

5. The athletic pants as defined in claim 2, further comprising a second pocket formed in each of the knee support regions in an area adapted to be laterally adjacent the opposite side of the athlete's knee from the pocket; and a second supporting member retained within each second pocket, wherein said second supporting member is entirely enveloped within said second pocket such that no part of the second supporting member is visible.

6. The athletic pants as defined in claim 5, wherein a longitudinal axis of each pant leg runs from the waistband through to the first annular region thereof; and wherein the pockets and second pockets lie substantially parallel to the longitudinal axis of the pant leg.

7. The athletic pants as defined in claim 1, further comprising an elastic cuff formed on a bottom end of the knee support region.

8. The athletic pants as defined in claim 1, wherein a longitudinal axis of each pant leg runs from the waistband through to the first annular region thereof and wherein the pants are ice hockey pants which further include:

a first strip of hook and pile fasteners disposed proximate the first annular region of each pant leg and oriented substantially at right angles to the longitudinal axis thereof; wherein said first strip is adapted to engage and secure an upper end of a hockey sock drawn over the pants.

9. The athletic pants as defined in claim 1, wherein the knee support regions are manufactured from a highly compressive material and the body and pant legs are manufactured from one or more of spandex and nylon.

10. The pair of athletic pants as defined in claim 1, wherein the pocket envelopes the supporting member to the degree that the supporting member is not visible when either of an interior surface and an exterior surface of the pant legs are viewed.

11. The pair of athletic pants as defined in claim 2, wherein each pocket is formed by an interior layer of fabric adapted to abut the athlete's skin and an exterior layer of fabric that is remote therefrom, and wherein the supporting member is non-removably retained within the pocket by a plurality of stitches that secure the interior and exterior layers of fabric together, and the plurality of stitches substantially completely encircle the supporting member.

12. The pair of athletic pants as defined in claim 5, wherein each of the second supporting members is non-removably retained within one of the second pockets.

13. The pair of athletic pants and defined in claim 1, wherein the pocket comprises a single continuous piece of fabric having a perimeter that is substantially entirely secured to the leg so as to envelope the supporting member.

14. The pair of athletic pants and defined in claim 5, wherein the second pocket comprises a single continuous piece of fabric having a perimeter that is substantially entirely secured to the leg so as to envelope the second supporting member.

15. The pair of athletic pants as defined in claim 8, further comprising:

a second strip of hook and loop type fastener disposed proximate the annular region of each pant leg and oriented substantially at right angles to the longitudinal axis thereof; wherein said first strip and said second strip are disposed equidistant from each other about a circumference of the pant leg.

16. The pair of athletic pants as defined in claim 1, wherein the pocket extends from proximate the first annular region to proximate the second annular region.

17. The pair of athletic pants as defined in claim 9, wherein the highly compressive material is neoprene rubber.

* * * * *